United States Patent [19]

Webster, III.

[11] Patent Number: 5,053,761

[45] Date of Patent: Oct. 1, 1991

[54] METHOD FOR SMOOTH BITMAP SCROLLING

[75] Inventor: John W. Webster, III., Apex, N.C.

[73] Assignee: International Business Machines, Armonk, N.Y.

[21] Appl. No.: 367,434

[22] Filed: Jun. 16, 1989

[51] Int. Cl.[5] ..... G09G 5/34

[52] U.S. Cl. ..... 340/726; 340/724; 340/799

[58] Field of Search ..... 340/726, 724, 799, 723, 340/798

[56] References Cited

U.S. PATENT DOCUMENTS 4,412,294 10/1983 Watts et al. .
4,437,093 3/1984 Bradley .
4,611,202 9/1986 DiNitto et al. .
4,649,379 3/1987 Canton et al. .
4,663,617 5/1987 Stockwell .
4,706,076 11/1987 Racchini .

*Primary Examiner*—Jeffrey A. Brier
*Assistant Examiner*—Regina Liang
*Attorney, Agent, or Firm*—Scully, Scott, Murphy & Presser

[57] ABSTRACT

Smooth scrolling of a document on an all points addressable system which provides fast response and scrolling in increments of a single display row, while being storage efficient. The document is completely stored in compact format and a portion of the document which encompasses the current display window is stored in bitmap image format. There is smooth scrolling between displays completely within the bitmap image. The scroll is only interrupted for a scroll outside the portion of the document in bitmap image format, in which case the bitmap image is adjusted using the compact format to include that portion of the document with the desired display.

15 Claims, 5 Drawing Sheets

METHOD FOR SMOOTH BITMAP SCROLLING

DESCRIPTION

1. Technical Field

The invention relates to displaying a document on a display screen of a computer or other digital storage device. The invention provides fast response and scrolling in increments of a single display row, while being storage efficient.

2. Discussion of the Prior Art

It is known in the art of displaying documents stored in the memory of a device that smooth scrolling of the portion of the document displayed on the display screen may be achieved by storing a subsection of the document off-screen in bitmap image format in a bitmap buffer larger than the on-screen portion and marking the portion with display pointers or markers. Smooth scrolling is achieved by moving a display marker in increments of rows of the off-screen bitmap image; this corresponds to the portion of the document displayed being moved up or down on the screen in increments of a single display row of the display. Since this is the finest change in the document that can be achieved on the display, it is by definition a smooth scroll. The term is relative however and can refer to changes of more than one scan line at a time. This is described in U.S. Pat. No. 4,611,202.

The prior art, however, does not address continuing to provide displayable data once the off-screen buffer is exhausted. The present invention focuses on this very point.

SUMMARY OF THE INVENTION

The present invention is a method of displaying a document on an all-points-addressable display system which provides smooth scrolling and fast response time while being storage efficient. Smooth scrolling is desirable since it provides the viewer with a sense of where the portion of the document presently on the display lies with respect to the rest of the document. In other words, it provides the viewer with a sense of continuity as the display is changed.

One way of achieving smooth scrolling alone is to use an offscreen buffer which stores the entire document in bitmap image format in accordance with the teaching of U.S. Pat. No. 4,611,202. Thus the display marker could move in row increments of the bitmap image throughout the entire document. Consequently, the display would move in increments of one row of display and a smooth scroll would be viewed for scrolling throughout the document.

The disadvantage of such a method of smooth scrolling is that storing the complete document in bitmap image format consumes a relatively large amount of interactive memory, thus requiring a large amount of memory in the scrolling subsystem for a given document.

The term "bitmap image format" is well known in the art. Generally, it refers to a memory array with intensity encoded values such that each successive memory array row corresponds to a successive row of the document as displayed by a row of display elements, and each successive group of one or more memory elements of each row of the memory array has an intensity encoded value which corresponds to successive display elements in the corresponding display row. Storing the entire document in bitmap image is not only memory intensive, but in many cases it is unnecessary. Often the viewer is scrolling the screen in a very small subsection of the document. The capability to scroll into other portions of the document is then irrelevant. The memory occupied by the bitmap image of those regions of the document is wasted.

A way to reduce the excessive and wasteful memory consumption which results from storing the entire document in bitmap image format is to only store that portion of the document which is currently being displayed in bitmap image format, and storing the remainder of the document in standard compact memory formats. Such compact memory formats are numerous and well known in the art to be character arrays, graphic arrays, etc. Thus, smooth scrolling would be achieved by rasterizing the compact memory format into bitmap image format line by line for the number of lines of the bitmap image corresponding to the extent of the scroll. Rasterizing as used here is a term known to the art and consists of retrieving and converting the relevant portions of the compact format of the document into bitmap image format. U.S. Pat. No. 4,723,210 describes compact storage of a document where the document has interleaved portions of text and graphics in both a vertical and horizontal sense, and the portions of the compact representation divide in this manner.

This approach, while being storage efficient, has the disadvantage of being too slow. When scrolling between portions of the document residing completely in the bitmap image, the delay between the input by the viewer and the scroll on the display is virtually instantaneous, being on the order of microsecond. However, rasterizing one line of text into bitmap image format takes anywhere from hundreds of milliseconds to several seconds depending on the complexity of the text. A document which is relatively complex, i.e., one which interleaves text, graphics, images, etc., for example, may therefore substantially delay system response time. Thus, the rasterization process cannot occur at speeds which may be demanded by the viewer by smooth scrolling the document. Furthermore, with the rasterization processing limiting the maximum scrolling speed, the scroll seen on the screen is choppy. In other words, the time delay between lines appearing on the screen is slow enough for the eye to distinguish.

The present invention is a method of achieving fast response and therefore smooth scrolling while being memory efficient. In the present invention, the entire document is stored in one or more compact formats. A cache or subsection of the document, which encompasses the portion of the document to be displayed, is stored in bitmap image format, or some other type of format, defined generally as "fast access format," which may be used to drive the display. The portion of the document to be displayed or "display frame" is marked in the bitmap image memory region. This marker signals the portion of the bitmap image which is to be outputted to the display. The marker can be moved in increments of a single row of the bitmap image throughout the bitmap image by means of an input device for scrolling. Moving the marker in single row increments leads to smooth scrolling on the display screen between portions of the document in bitmap image format. The smooth scrolling is interrupted only when the display frame denoted by the marker is moved to the top or bottom of the bitmap image and, consequently, some or all of the portion of the document to be displayed is not present in the cache. According to the present invention, a rasterization process then occurs. The end result of the rasterization process is the complete portion of the document to be displayed in the center of the cache in bitmap image format and bordering portions in the cache filled with correct bitmap images representing the neighboring regions of the document along with the marker being adjusted to output the desired display portion.

DETAILED DESCRIPTION OF THE PREFERRED EMBODIMENT

Figure 1:
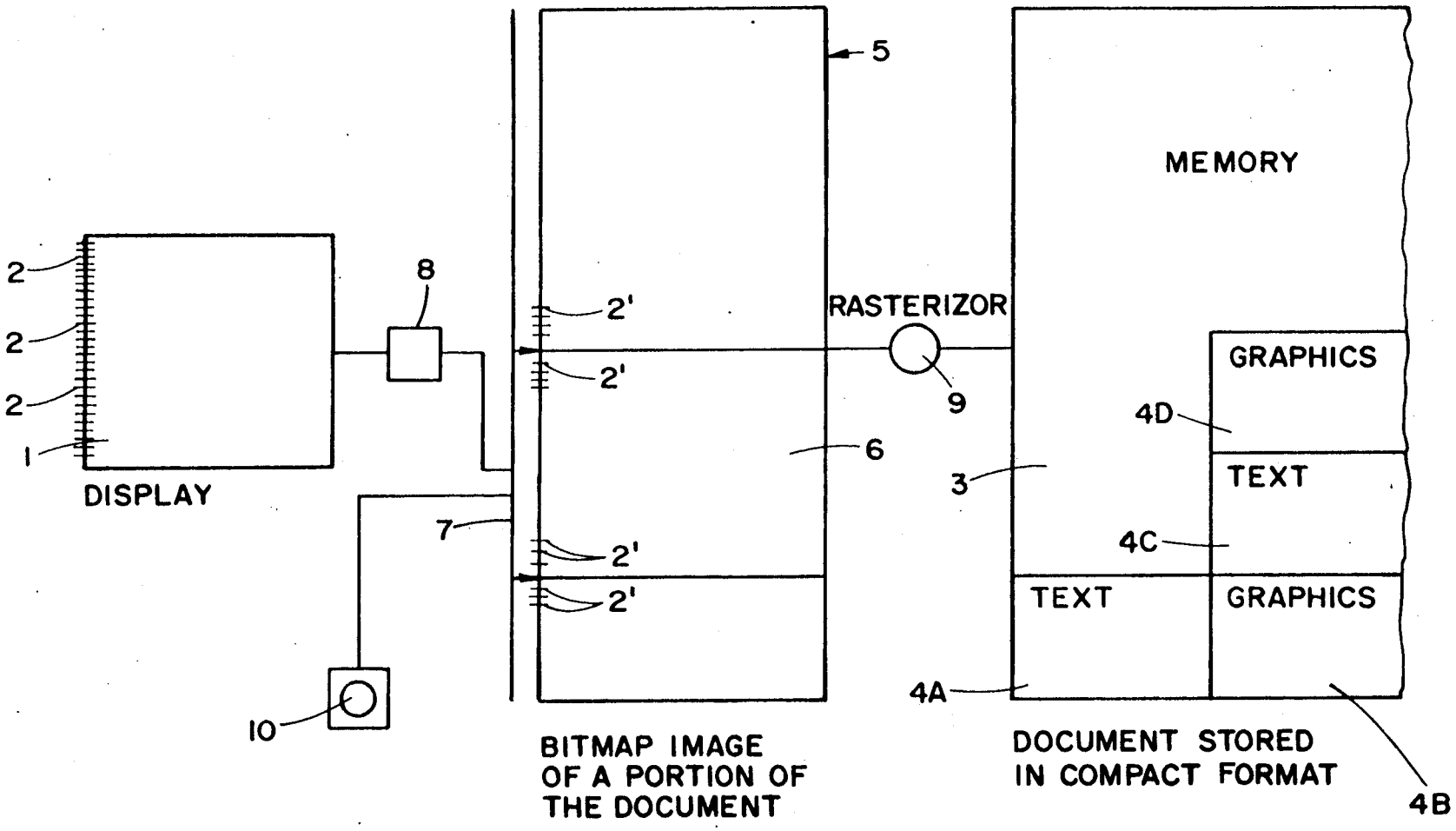
FIG. 1 is a block diagram in which the necessary components required for the present invention are represented.

Referring to FIG. 1, a block diagram illustrating the components of the present invention is shown. It is to be noted throughout the ensuing discussion that the components pictured do not correspond to any specific piece or pieces of hardware. The pictured components may also encompass more than one piece of hardware. In other words, the method and device of this invention may be implemented in many specific configurations with countless varieties of hardware components. Those skilled in the art, however, will easily be able to design specific devices from the following necessarily general description.

In FIG. 1, memory 3 of a computing device stores a document in compact format. The compact format of the document is partially shown as elements 4A, 4B, 4C and 4D. Element 4A and 4C are shown to be portions of the text of the document while elements 4B and 4D are shown to be portions of the graphics of the document. The compact representation is shown to be in sections to emphasize that the particular storage methods of each machine will vary and the storage format of any particular machine may divide the document into portions for storage efficiency. The document may have interleaved portions of text and graphics in both a vertical and horizontal sense, and the portions of the compact representation may divide in this manner. In many machines, the compact format includes character and graphic arrays stored in structured format.

A portion or cache 5 of the document is stored in bitmap image format. The display window of the document is defined as that portion of the document to be displayed on the display 1. In FIG. 1, the display window 6 resides completely within the portion of the document in the bitmap image 5. The display window 6, residing completely within the bitmap image, has the same number of rows 2' as the number of scan lines 2 of the display 1. The display window is marked with display marker 7 which may be moved up or down in increments of one row 2' of the bitmap image by input device 10.

At least part of the display window 6 as marked by display marker 7 is outputted to display hardware 8. Assuming display 1 scans in the raster fashion of a standard CRT, then the cache is typically stored in a raster buffer. At least the line 2' of the display window 6 which corresponds to line 2 of the display 1 being physically scanned is outputted to a storage region of the display hardware 8. The display hardware converts the intensity encoder signals of the bitmap image into electronic signals which are recognized by the display element intensity controller. Often a number of lines 2' below the current line 2 being physically scanned are stored in a number of line buffers in the display hardware 8. These buffers are reloaded from the bitmap image as the scan progresses. The display element intensity controller for a standard CRT, for example, is the intensity controller of the electron gun.

From the above, moving the display marker 7 by one row 2' of the bitmap image is viewed on the display as a change of one scan line 2.

The cache 5 is created by rasterizor 9 accessing the appropriate portions of the document in memory 3, converting from compact format into bitmap image format, and loading the bitmap image 5.

The display 1 and display hardware 8 of FIG. 1 may, for example, consist of an IBM Video Gate Array (VGA) attached to a PS/2 monochrome display. The cache 5 may be stored in an IBM PC 64K byte memory segment. The entire document, stored in compact formal, may reside in multiple IBM PC 64K memory segments, used in structured application.

The compact format itself may be, for example, a single font text format or a multiple font text format.

The function of the rasterizor 9 is that of a realtime document formatter.

Figure 2:
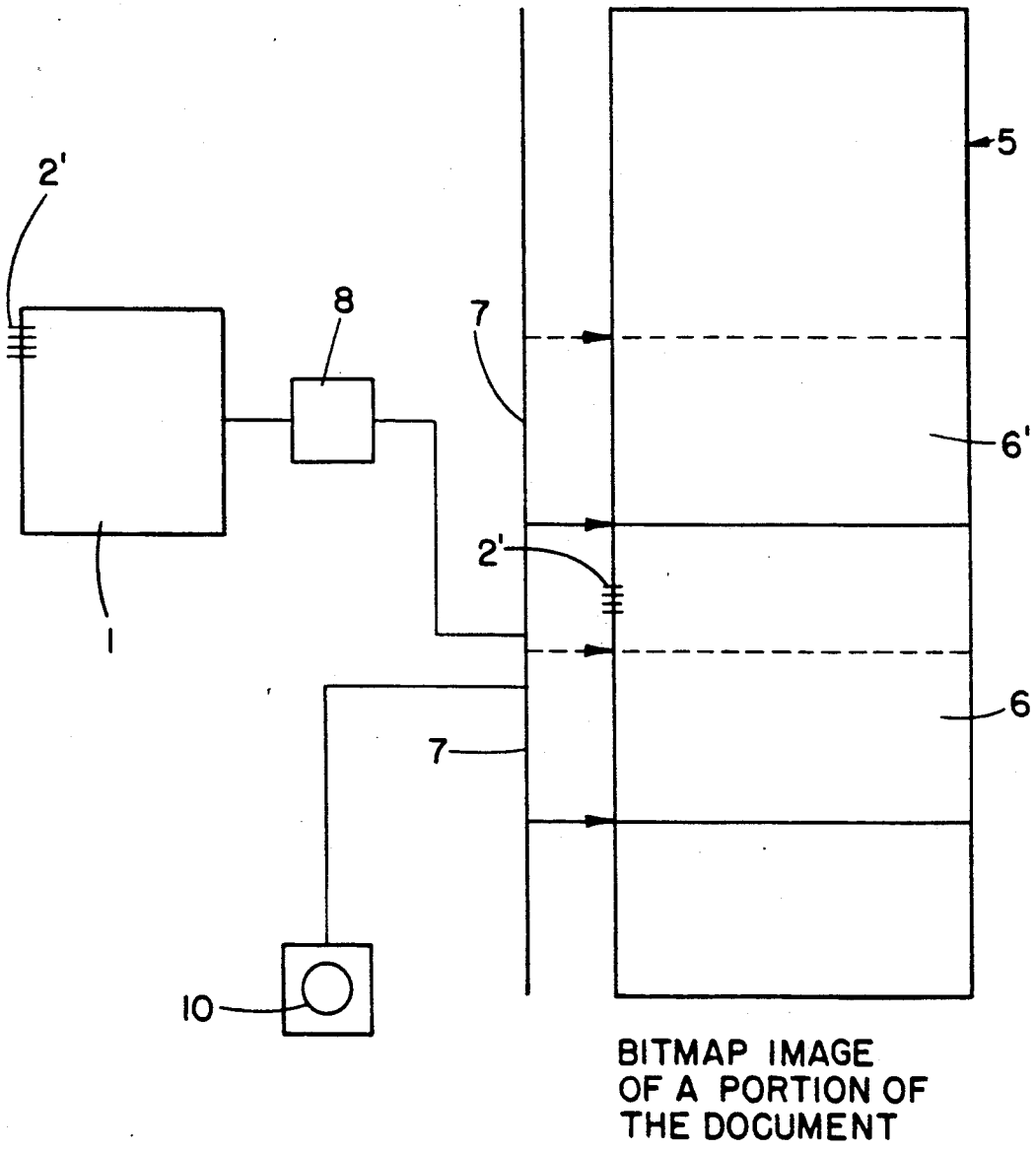
FIG. 2 is a block diagram showing the bitmap image of a portion of the document where the display marker is moved such that the display window before and after the move is completely within the bitmap image.

Referring to FIG. 2, the initial display window 6 resides completely within the bitmap image 5 as defined by the position of display marker 7. This display window 6 corresponds to the portion of the document seen on display 1. The display marker 7 is then moved by input device 10 such that the final display window 6', shown by dashed lines, also resides completely within the bitmap image 5. This display window 6' then corresponds to the portion of the document seen on display 1.

Furthermore, if the input device 10 is scrolled such that display marker 7 moves directly from its initial to final position, then, since the display marker 7 is constrained to move in increments of single rows 2' of the bitmap image 5, the correllative change between the initial and final portions of the document as viewed on display 1 occurs in increments of single scan lines 2 of the display 1. This is perceived as a smooth scroll with no delay between the input by the viewer at input device 10 and the scroll on display 1.

The above assumes that the input device 10 is in "scroll" mode. The system may have additional capability to allow the user to "jump" to a desired portion of the document by using the input device 10. This would move the display marker to the final display window 6' without moving between intervening lines 2'. The change on the display would be a discrete change between the initial and final display window rather than a scrolled change. Of course, the user may "jump" from an initial display window within the cache to a final display window outside the cache, in which case adjustment of the cache will occur as described below so that the desired display window is encompassed within the cache.

It is noted that in the case of a relatively large document, the viewer is normally interested in scrolling within a small section of the document, such as in editing or simply reading the document in sequence. Assuming that the portion of interest is encompassed by the cache, the viewer will be able to view a smooth scroll in the portion of interest.

Figure 3:
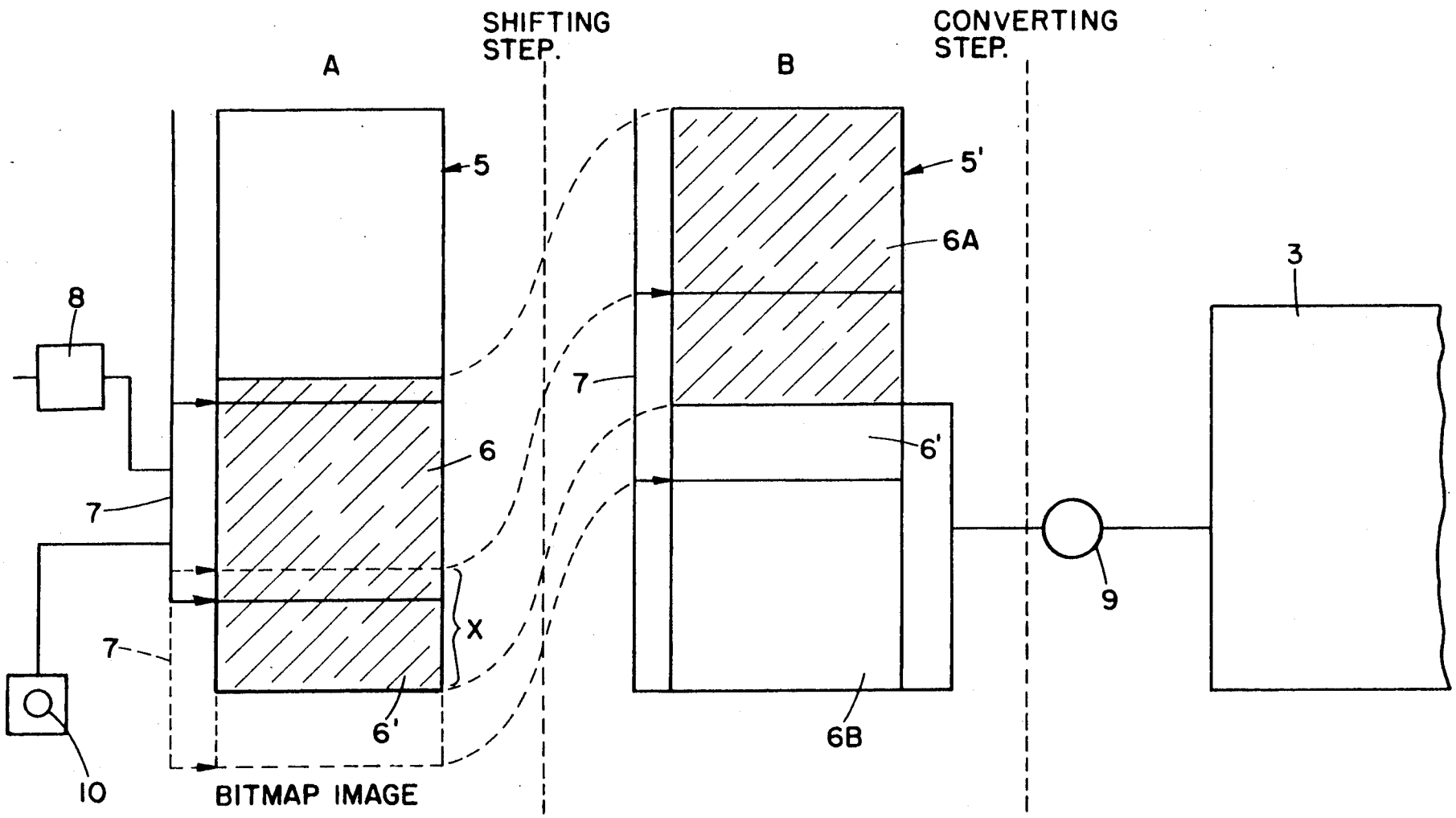
FIG. 3 is a block diagram showing the bitmap image of a portion of the document where the display marker is moved such that the display window after the move is partially within the bitmap image.
Figure 4:
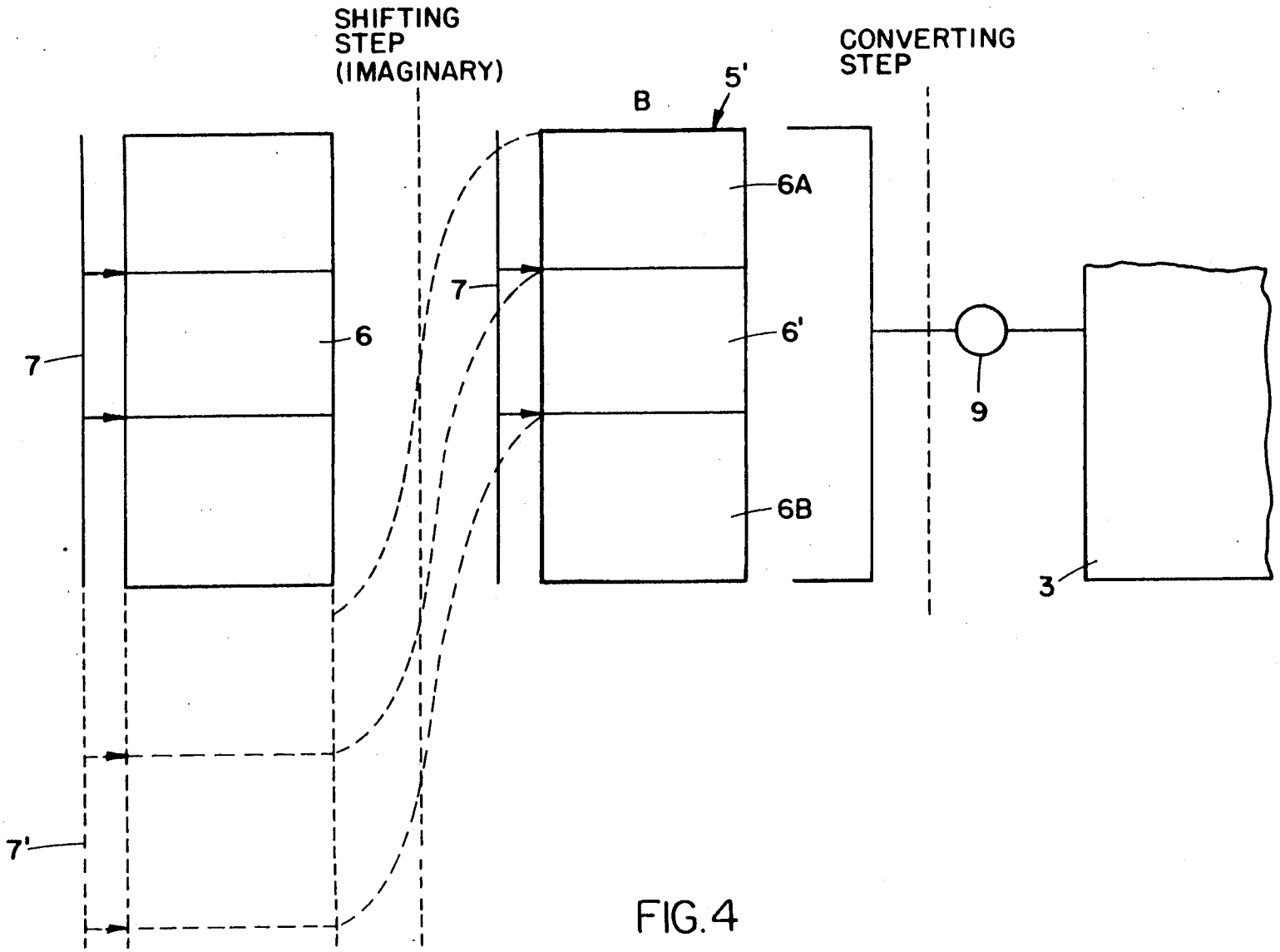
FIG. 4 is a block diagram showing the bitmap image of a portion of the document where the display marker is moved such that the display window after the move is completely outside the bitmap image.

FIGS. 3 and 4 demonstrate the present invention when the display marker 7 is moved such that some or all of the display window 6' of the portion of the document to be displayed is not within the bitmap image. It is emphasized that this is a relatively unusual event since the user will normally be interested in scrolling within a small region of the document completely encompassed by the cache, as in FIG. 2. When this occurs, the scroll on the display 1 is necessarily interrupted as the bitmap image is adjusted to contain a new cache which completely includes the display window 6' of the portion of the document to be displayed.

Referring to FIG. 3, specifically that portion labelled A, the display marker 7 is shown at an initial position defining initial display window 6, shown by solid line boundaries, and at a final position defining final display window 6', shown by broken line boundaries. Display marker 7 is again moved by input device 10. The movement of display marker 7 to final display window 6' may be by the input device 10 in "scroll" mode or "jump" mode. It is seen in FIG. 3 that final display window 6' lies partially within and partially without bitmap image 5. Thus, the output to display intensity controller 8 is insufficient to fill display 1.

It should be noted that the physical embodiment of display marker 7 does not actually move outside the bitmap image 5 as shown in FIG. 3. There is a counter in the system, not shown in the Figures, which keeps track of the number of lines below the cache the display marker has been moved and, consequently, the relationship between the present cache and the final display window and, thus, the new display area within the document. FIG. 3 is representative of the relative position of the portion of the document to be displayed with respect to the present cache when the display marker 7 moves to the extreme of the bitmap image 5. To facilitate the description, the display marker 7 and the final display window 6' are shown as imaginary extensions, shown by broken lines, of the bitmap image 5'. In the hardware, however, the relative positions are maintained by the counter.

In FIG. 3, at A, display marker 7 is moved as described above, from initial display window 6 to final display window 6'. Final display window 6' is only partially present in the cache residing in bitmap image 5'. The portion of display window 6' not in the cache is represented by the dashed line extension of bitmap image 5'.

When a scroll occurs as in FIG. 3, or, in general, when some or all of the final display window is outside the cache, the scroll as viewed on the display must be interrupted. If the input device 10 is being scrolled, the display may "freeze" the last complete display window at the extreme of the cache, while the adjustment step occurs as described below. If the input device is in "jump" mode, the display may "freeze" the initial display window of the cache while adjustment occurs.

According to the present invention, when this occurs the cache is adjusted as illustrated in FIG. 3 so that the bitmap image 5 contains complete final display window 6'. In FIG. 3, the bitmap image 5 is shown to be adjusted at B so that the final display window 6' lies in the center of the cache. In other words, two discretionary fringes 6A, 6B of the cache above and below the final display window 6' have an equal number of rows.

The dashed lines between the bitmap image 5 shown at A before adjustment of the cache and the bitmap image 5' shown at B after adjustment of the cache shows the spatial relationship between the same portion of the document stored in the bitmap image 5 before and after adjustment. It is seen that the shaded portion at the bottom of the cache in bitmap image A appears at the top of the cache in bitmap image B after the adjustment step.

In the preferred embodiment of the present invention, the first step of the adjustment process consists of moving any usable portion of the present cache to the opposite side of the cache. The usable portion of the cache is defined as that portion of the cache present in the bitmap image 5 before adjustment which appears in the cache after the adjustment. The usable portion of the cache depends on the position of the final display window 6' and the sizes of the discretionary fringes above 6A and below 6B the final display window 6' after adjustment. In FIG. 3, for example, with the display marker 7 scrolled to final display window 6' of A, and the adjustment process set to load an equal discretionary fringe above 6A and below 6B the final display window at B, the shaded area at A is a usable portion and therefore is moved to the top of the bitmap image 5' at B in the first step of the adjustment process. It is seen that the move is a pure vertical shift of the usable portion within the bitmap image. That is, the horizontal lines of the usable portion maintain their relative order, with the first line of the usable portion moved to the first line of the cache, the second line of the usable portion shifted to the second line of the cache, etc.

To demonstrate the dependence of the usable portion on movement of the display marker 7 and the sizes of the discretionary fringes 6A, 6B, FIG. 4 demonstrates a relatively large scroll or jump where the top of the final display window 6' at A is scrolled beneath the bottom of the bitmap image 5 by a number of rows greater than the discretionary fringe 6A above the final display window 6' at B. It is seen by the dashed lines showing relative positions between the portions of the cache at A and the cache at B that none of the present cache at A appears in the post-adjustment cache at B; therefore, there is no usable portion as a result of the relatively large scroll. Similarly, in FIG. 4, if the discretionary fringe 6A at B was zero rows, i.e., the final display window 6' appeared at the top of the cache at B, then a scroll where the top of the final display window 6' at A was one row beneath the bitmap image 5 would result in no usable portion. However, a discretionary fringe 6A at B of zero rows for the scroll in FIG. 3 would result in the portion of the final display window 6' labelled X at A appearing at the top of the cache at B; therefore X would be the usable portion for zero upper discretionary fringe 6A.

The usable portion is always written from one end of the cache to the other in order to move the final display window, located partially or completely outside the cache, into the cache after the adjustment step. By definition, the usable portion is that portion of the adjusted cache which is located at the opposite end. If the scroll were to the top end of the bitmap image 5 in FIG. 3, the usable portion would be written to the bottom of the bitmap image 5 in the first adjustment step.

The writing of the usable portion from one end of the bitmap image to the other may be accomplished row by row starting by writing the row of the usable portion opposite the border of the bitmap image to the opposite border of the bitmap image. The hardware to accomplish this step is not represented in the figures.

The purpose of shifting the usable portion of the present cache in the first adjustment step is to avoid repeated rasterization of the usable portion, an unnecessarily slow process.

Referring to FIG. 3, after the usable portion, represented by the shaded portions of the cache, is moved to the opposite end of the bitmap image 5', the next step of the adjustment process consists of filling the remainder of the bitmap image 5', the unshaded portion at B, with the remainder of the cache beneath the usable portion. For this, the appropriate portion of the compact representation of the document in memory 3 is accessed, rasterized into bitmap image format by rasterizor 9 and loaded into bitmap image 5'. In FIG. 3, it is seen at B that the portion of the cache corresponding to part of the final display window 6'and the complete lower discretionary fringe 6B is loaded into the bitmap image 5' at B by the rasterizor 9 in this step.

The rasterization step can, of course, completely supplant the shifting step. Such is the case in FIG. 4, where there is no usable portion of the initial cache. The complete final cache is therefore loaded into the bitmap image 5' at B by the rasterizor 9. While a scroll or jump of this magnitude would be the worst case in terms of response time, such a change will be relatively rare, as described above. Furthermore, occasional prolonged response time, as in this case, is the result of storing less than the complete document in bitmap format, and thus reducing the interactive memory requirements.

In order to "know" the appropriate portions of the compact representation to rasterize, rasterizor must have an input derived from the counter, described above, the sizes of the discretionary fringes and the size of the cache which either directly inform rasterizor which portions of the compact memory need to be converted to "fill in" the cache, or allow the rasterizor to determine those portions.

The rasterizor, while performing a relatively simple conceptual step in the present invention, performs a number of complex steps on a hardware level to carry out that step.

The rasterizor encompasses a portion of the CPU of the computer, since it must address and access the compact memory, and a portion of the display subsystem, since it converts the compact memory into the bitmap image format appropriate for the display. As an example, the POLITE formatter will access a complex document format consisting of "blocks" of text, graphics, image and use promotive functions such as character generators, line drawers and generators to produce bitmap output.

The final step of the adjustment process is moving display marker 7 to mark display window 6' of the newly adjusted cache. This step is shown completed at B in FIGS. 3 and 4.

The outcome of the adjusting step in FIGS. 3 and 4 at B is a cache in the bitmap image 5' with the display window 6' of the portion of the document to be displayed in the center of the bitmap image 5'. As described above, smooth scrolling may be achieved between display windows completely within the cache, as in FIG. 2.

It should be noted that the three steps of the adjusting process may occur in any order in approximately an equivalent amount of time. Also, the rasterizor may be converting the compact format and loading portions of the bitmap image at the same time the usable portion of the cache is being shifted.

Other aspects of the present invention include variable discretionary fringes which may be changed by the user depending on his requirements. When the user is editing specific portions of a document, it is desirable to have equal discretionary fringes around the display window after an adjustment process, since the user will be scrolling up and down in a specific region. However, if the viewer is reading the document, or editing the complete document in sequence, a zero top discretionary fringe would be desirable, since the user will be scrolling continuously downward through the cache. This would reduce adjustment cycles since the lower discretionary fringe would be larger.

When there is a usable portion, some subjective continuity in the display may be achieved during the adjustment cycle. Prior to the adjustment cycle, the display marker 7 has been moved out of the cache, as in FIG. 3. Until that point, the viewed scroll is smooth. Rather than continuing the scroll on the display before the adjustment process, which would simply scroll the last full display window of the cache partly or fully off the screen, the display would continue to output the last full display window at the bottom of the cache. This would only be reduced if the scroll were such that the usable portion of the cache became less than the last full display window, in which case only the usable portion would be displayed. After the complete rasterization step, or after each line of the step, the display would be "filled in" or moved line by line until the final display window appeared on the display.

Figure 5:
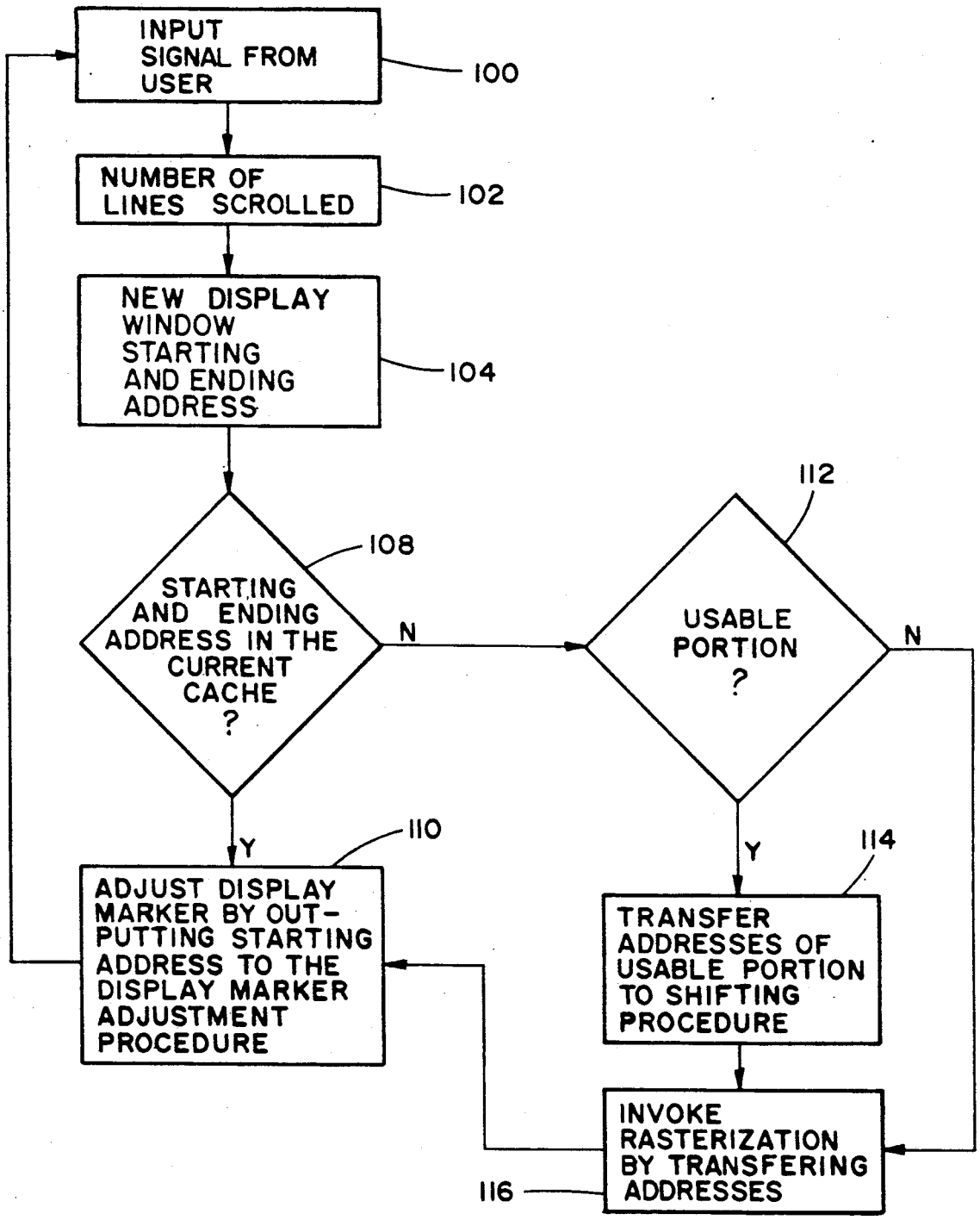
FIG. 5 is a flowchart of the preferred embodiment of the present invention.

Referring to FIG. 5, a flow chart describing the preferred embodiment of the algorithm of the present invention is shown. The algorithm may be controlled by a program stored in the microprocessor of a computer which is executed each time a scroll input is received from the user.

As indicated, the algorithm is initiated upon an input signal from the user 100 which corresponds to a scroll. The scroll signal may be a digitally encoded signal which corresponds to the displacement of the input device, for example. The particular input depends on the input device used for scrolling in the particular machine. Whichever one is chosen, the particular signal for vertical scrolling must be determined from the device's reference document and the microprocessor translates the input signal into the number of lines in the bitmap image which is scrolled 102. Naturally, the scroll can correllate to more lines than are available in the bitmap image. This corresponds to scrolling into the "imaginary" portion of the bitmap image as in FIGS. 3 and 4. In this case the determination of the number of lines scrolled 102 by the microprocessor will exceed the number above or below the current display window of the bitmap image.

From the number of lines scrolled, the starting and ending addresses of the new display window 104 in the bitmap image are determined. If the bitmap image addresses are consecutively numbered, the new starting address is determined by multiplying the number of lines scrolled by the number of display elements per line, and adding the product to the current bitmap window starting address. The specifics of the particular bitmap storage medium must be considered in this step. If the scroll exceeds the number of lines above or below the current display, the starting or ending address or both may be outside the bitmap image.

The algorithm then determines if the new display window resides completely in the current cache 108. The new display's bitmap starting and ending addresses are compared with the starting and ending addresses of the bitmap image itself or the "actual" bitmap image. If both addresses of the new display fall within the actual addresses of the bitmap image, the algorithm simply moves the display marker by outputting the starting and ending address to the display marker adjustment procedure 110.

Adjustment of the display marker of a bitmap image by inputting new bitmap image addresses is dependent on the bitmap medium and supporting hardware and software. This step corresponds to "normal" scrolling completely within a bitmap image and may be implemented in numerous different ways available commercially and/or well documented in the art. See, for example, Foley and Van Dam, *Fundamentals of Interactive Computer Graphics* (Addison Wesley). The algorithm of the present invention must at this junction invoke the particular adjustment routine and hand off the appropriate data for adjustment, be it bitmap addresses or some equivalent.

If the algorithm of the present invention determines that the starting and/or ending bitmap address of the new display window is not within the actual bitmap image, whether there is a usable portion of the cache is then determined 112. If either the starting or ending bitmap address of the new display is in the actual bitmap image, then there is a usable portion. This situation corresponds to FIG. 3. If both the starting and ending bitmap addresses of the new display are outside the actual bitmap image, then there may or may not be a usable portion. If the end bitmap address of the new display window is greater than the end address of the actual bitmap image, the usable portion determination 112 may be accomplished by subtracting the address width of the upper discretionary fringe from the starting bitmap address of the new display and determining if it lies within the actual bitmap addresses. The "address width" of the discretionary fringe is defined as the difference between the starting and ending bitmap addresses of the discretionary fringe. If there is a usable portion in this instance, it corresponds to the portion of the image between the address obtained by the above-cited subtraction, and the ending address of the actual bitmap image.

If on the other hand the beginning bitmap address of the new display window is less than the beginning address of the actual bitmap image, the usable portion determination 112 may be accomplished by adding the address width of the lower discretionary fringe to the ending bitmap address of the new display and determining if it lies within the actual bitmap addresses. If there is a usable portion in this instance, it corresponds to the portion of the image between the beginning address of the actual bitmap image and the address obtained by the above-cited addition.

If there is a usable portion, and the bitmap addresses of the current bitmap image corresponding thereto are determined as described above, the microprocessor invokes a block shift routine of the bitmap image. The address of the usable portion and the starting and ending addresses of the actual bitmap image are used by the routine to shift each row of the usable portion to the opposite end of the bitmap image.

The block shift routine algorithms are numerous and well documented. Commercial embodiments are widely available and documented and may be adapted for use by the algorithm of the present invention by handing off the appropriate addresses corresponding to the bitmap memory to be shifted and the area in the bitmap memory it is to be shifted to.

For algorithms describing bitmap block shift, see, for example, the Foley and Van Dam text, cited supra. Block shifting of a bitmap image is also utilized in a prior art device, the PERQ Mini-Computer, manufactured by Three Rivers Computer Co. and is described in the supporting technical documents.

If there is no usable portion, then the entire bitmap image must be rasterized 116. Even if there is a usable portion, then some portion of the bitmap image must be rasterized 116 from the compact representation. To determine the addresses of the compact memory which must be rasterized, the bitmap addresses corresponding thereto are first determined based on the bitmap starting and ending addresses of the new display window and the sizes of the discretionary fringes. The bitmap addresses of the portion required to be rasterized will necessarily lie outside the actual bitmap addresses. These bitmap addresses are passed off to the rasterization procedure where they are correllated to the compact memory addresses based on the compact memory addresses of the current cache in the bitmap image. The compact memory is rasterized and loaded serially into either the complete bitmap image or the portion above or below the shifted usable portion.

The correlation step may take place in the rasterization algorithm. Rasterization algorithms, including correllation features, are documented in Pazlidis, *Algorithms for Graphics and Image Processing* (Computer Science Press). The rasterizor must ultimately have the target compact memory addresses, but with correllation the bitmap addresses of the portion to be rasterized and the compact addresses of the original cache in the bitmap image enable the compact memory addresses to be determined.

Once the rasterizer is invoked and the new bitmap image is complete the display is moved to its relevant bitmap address 110.

The above description is not intended to limit the invention to those embodiments specifically described. Other embodiments and variations will naturally occur to those skilled in the art.

Having thus described out invention, what we claim as new, and desire to secure by Letters Patent is:

1. A high speed and storage efficient method of processing information for smooth scroll display of a document on an all points addressable display system, said method comprising the steps of:

(1) storing the entire document in one or more compact formats, (2) storing a cache of the document which is smaller than the complete document offscreen in fast access format, including a complete display window of the initial portion of the document to be displayed, (3) marking the portion of the cache which contains the complete display window of the current portion of the document to be displayed with a display marker, the display marker moving in increments of the cache which corresponds to increments of at least one row of the display screen, (4) outputting the contents of the display window marked by the display marker for display on the screen, (5) adjusting the cache to include the complete display window of the desired screen display when the display marker is moved to a portion of the cache which does not contain the complete display window of the portion of the document to be displayed, whereby a smooth scroll is viewed on the display when the display marker is moved by the input means such that the cache contains the complete display window of the new portion of the document to be displayed due to the display window and, consequently, the display viewed, being varied in increments corresponding to one scan line of the display; the smooth scroll being interrupted only when the display marker is moved such that the cache does not contain the complete window of the new portion of the document to be displayed.

2. The method according to claim 1 wherein the step of adjusting the cache includes, when there is a usable portion of the cache, the additional steps of (1) shifting the usable portion of the display on the opposite end of the cache, (2) converting the portion of the entire document which corresponds to the portion of the document in the remaining portion of the cache into fast access format and loading it into the cache, (3) marking the portion of the cache which corresponds to the display window of the portion of the document to be displayed with the display marker.

3. The method according to claim 2 wherein the step of adjusting the cache includes, when there is no usable portion, the additional steps of:

(1) converting a section of the entire document into fast access format and completely filling the cache, the section converted resulting in the cache containing the complete display window of the portion of the document to be displayed plus a discretionary fringe above and below the display window, (2) marking the portion of cache which corresponds to the display window of the portion of the document to be displayed with the display marker.

4. The method according to claims 1, 2 or 3 wherein after the adjusting step the cache contains the complete display window of the portion of the document to be displayed with an equal discretionary fringe above and below the display window.

5. The method according to claims 1, 2 or 3 wherein the fast access format of the cache is the bitmap image format of the display.

6. The method according to claim 5 wherein the step of adjusting the cache includes rasterizing the portion of the compact representation into bitmap image format.

7. The method according to claim 6 wherein the cache is stored offscreen in a raster buffer.

8. The method according to claim 7 wherein the display marker marks a number of rows in the raster buffer equal to the number of rows of display elements in the display, and moves in increments of one row of the raster buffer per input signal from the input means.

9. The method according to claim 8 wherein the display scans in standard raster fashion, and the display intensity controller of the display accesses the row of the display window at the beginning of the sweep of the corresponding display row.

10. The method according to any of claims 2, 2, or 3 wherein the entire document consists of two or more interleaved portions of text and graphics, image, and non-character input data.

11. The method according to claim 10 wherein storing the entire document in compact format consists of storing the one or more portions of text in one or more regions of a volatile or non-volatile memory in one or more character arrays.

12. The method according to claim 11 wherein storing the entire document in compact format consists of storing the one or more portions of graphics in one or more regions of a volatile memory in one or more graphics array.

13. A high speed and storage efficient method of processing information for smooth scroll display of a document on an all points addressable display system, said method comprising the steps of:

(1) storing the entire document in one or more formats, (2) storing a cache of the document which is smaller than the complete document offscreen in a display compatible format, including a complete display window of the initial portion of the document to be displayed, (3) marking the portion of the cache which contains the complete display window of the current portion of the document to be displayed with a display marker, the display marker moving in increments of the cache which corresponds to increments of at least one row of the display screen, (4) outputting the contents of the display window marked by the display marker for display on the screen, (5) adjusting the cache to include the complete display window of the desired screen display when the display marker is moved to a portion of the cache which does not contain the complete display window of the portion of the document to be displayed, whereby a smooth scroll is viewed on the display when the display marker is moved by the input means such that the cache contains the complete display window of the new portion of the document to be displayed due to the display window and, consequently, the display viewed, being varied in increments corresponding to one scan line of the display; the smooth scroll being interrupted only when the display marker is moved such that the cache does not contain the complete window of the new portion of the document to be displayed.

14. The method according to claim 13 wherein the step of adjusting the cache includes, when there is a usable portion of the cache, the additional steps of (1) shifting the usable portion of the display on the opposite end of the cache, (2) converting the portion of the entire document which corresponds to the portion of the document in the remaining portion of the cache into display compatible format and loading it into the cache, (3) marking the portion of the cache which corresponds to the display window of the portion of the document to be displayed with the display marker.

15. The method according to claim 14 wherein the step of adjusting the cache includes, when there is no usable portion, the additional steps of:

(1) converting a section of the entire document into display compatible format and completely filling the cache, the section converted resulting in the cache containing the complete display window of the portion of the document to be displayed plus a discretionary fringe above and below the display window, (2) marking the portion of the cache which corresponds to the display window of the portion of the document to be displayed with the display marker.

* * * * *

UNITED STATES PATENT AND TRADEMARK OFFICE

CERTIFICATE OF CORRECTION

PATENT NO. : 5,053,761

DATED : October 1, 1991

INVENTOR(S) : John W. Webster III

It is certified that error appears in the above-identified patent and that said Letters Patent is hereby corrected as shown below:

Column 12, line 6, Claim 10: "claims 2, 2, or 3" should read as --claims 1, 2 or 3--

Signed and Sealed this

Ninth Day of March, 1993

*Attest:*

STEPHEN G. KUNIN

*Attesting Officer*

*Acting Commissioner of Patents and Trademarks*